US005782657A

United States Patent [19]

Wolla et al.

[11] Patent Number: 5,782,657

[45] Date of Patent: Jul. 21, 1998

[54] ELECTRICAL CONNECTOR WITH SECONDARY LOCK

[75] Inventors: David Maurice Wolla, Winston-Salem, N.C.; Keith Robert Denlinger, Lancaster, Pa.

[73] Assignee: The Whitaker Corporation, Wilmington, Del.

[21] Appl. No.: 421,637

[22] Filed: Apr. 13, 1995

[51] Int. Cl.[6] ..... H01R 13/40

[52] U.S. Cl. ..... 439/595; 439/752

[58] Field of Search ..... 439/752, 271, 439/273, 595

[56] References Cited

U.S. PATENT DOCUMENTS

| | | | |
|---|---|---|---|
| Re. 34,539 | 2/1994 | Aoyama | 439/752 |
| 4,113,333 | 9/1978 | Horowitz | 339/14 P |
| 4,557,543 | 12/1985 | McCleerey et al. | 339/97 P |
| 4,867,711 | 9/1989 | Yuasa | 439/752 |
| 4,979,913 | 12/1990 | Aiello et al. | 439/596 |
| 5,030,142 | 7/1991 | Hess et al. | 439/752 |
| 5,116,236 | 5/1992 | Colleran et al. | 439/271 |
| 5,167,534 | 12/1992 | Ohsumi | 439/752 |
| 5,492,487 | 2/1996 | Cairns et al. | 439/271 |
| 5,503,573 | 4/1996 | Sagawa | 439/752 |

FOREIGN PATENT DOCUMENTS 591 972 4/1994 European Pat. Off. ..... H01R 13/436

OTHER PUBLICATIONS

Sketch of prior art product pp. 1 and 2.

*Primary Examiner*—Neil Abrams
*Assistant Examiner*—Eugene G. Byrd

[57] ABSTRACT

A plug housing assembly (10) with an outer socket (20), and inner socket (30), a primary latching member (40), a secondary lock member (60) and electrical contact assemblies (80). The inner socket (30) includes contact receiving apertures (34) for receiving latching beams (44) of the primary latching member. The secondary lock member (60) is inserted transversely relative to the contact insertion direction into inner socket (30) so that walls (65*a*) of contact chamber (65) will engage a sleeve (82) of electrical contact assembly (80), and bottom wall (66*a*) of latch chamber (66) of secondary lock member (60) will be disposed adjacent to latching beams (44) so that the beams (44) are secondarily locked into place.

9 Claims, 6 Drawing Sheets

ELECTRICAL CONNECTOR WITH SECONDARY LOCK

The present invention relates to an electrical connector with primary and secondary locking members. More particularly, the present invention relates to an electrical connector plug housing with a secondary lock member disposed in a recess of the plug housing whereby electrical contacts disposed in the plug housing are positively locked into place by walls formed on the secondary lock member which engage respective sleeves surrounding the electrical contacts.

BACKGROUND OF THE INVENTION

A known electrical connector providing a secondary locking mechanism is disclosed in U.S. Pat. No. 5,116,236. This known electrical connector is provided with a transversely aligned terminal position assurance component that is slidably insertable into a transverse keyway in the electrical connector housing. The terminal position assurance component includes a plurality of flexible primary latches and a corresponding plurality of static secondary locks. Upon complete insertion of all terminals, the terminal position assurance component is indexed transversely into a final, locked position such that the static secondary locks thereof positively engage each terminal to thereby ensure complete insertion. This known connector provides a means of assuring that electrical terminals are in proper place within the plug housing; however, it is difficult to remove contacts which have been damaged or misaligned because a tool must be inserted in a contact aperture of the plug housing. Moreover, this known electrical connector does not provide a readily observable inspection means for the operator to observe that the terminal position assurance component has been fully inserted. Additionally, since the primary, deflectable latches are connected to the terminal position assurance component, the latches can be damaged when the terminal position assurance component is being transversely reciprocated. Also this known connector does not provide a sufficient means for simultaneous primary and secondary locking of the terminals in the housing. Further, the terminal position assurance component, if it is not aligned properly with respect to each contact, will not be able to be fully inserted into the plug housing.

The present invention seeks to overcome the deficiencies of the prior connector by providing an electrical connector which: provides a means of readily observing that the secondary lock member is fully in place, and that the electrical contacts within the plug housing are in their proper position; avoids breakage or misalignment of the secondary lock member; provides a means of removing contacts which have been damaged or worn by the use of a tool which is not required to use the contact aperture for insertion of the tool; separates the resilient latching beams from the secondary lock member by forming them on a primary locking member; provides shoulders on the secondary lock member which, when the secondary lock member is activated, will align the contacts axially so that the secondary locking member can be fully advanced into its final position; includes a bearing surface on the secondary locking member for positively engaging the primary locking beams of the primary locking member; and is reliable, inexpensive, and uses a minimum amount of space.

SUMMARY OF THE INVENTION

The present invention provides an electrical plug housing assembly for receiving at least one electrical contact therein and for matable connection with a further electrical housing, and comprises: an inner socket having at least one contact receiving aperture, a mating face for receiving a primary latching member, and a recess for receiving a secondary locking member; a primary latching member disposed on the mating face, the primary latching member comprises at least one contact receiving aperture; and a secondary locking member disposed in the recess, the secondary locking member comprises at least one contact receiving aperture plurality.

DETAILED DESCRIPTION OF THE INVENTION

Figure 1:
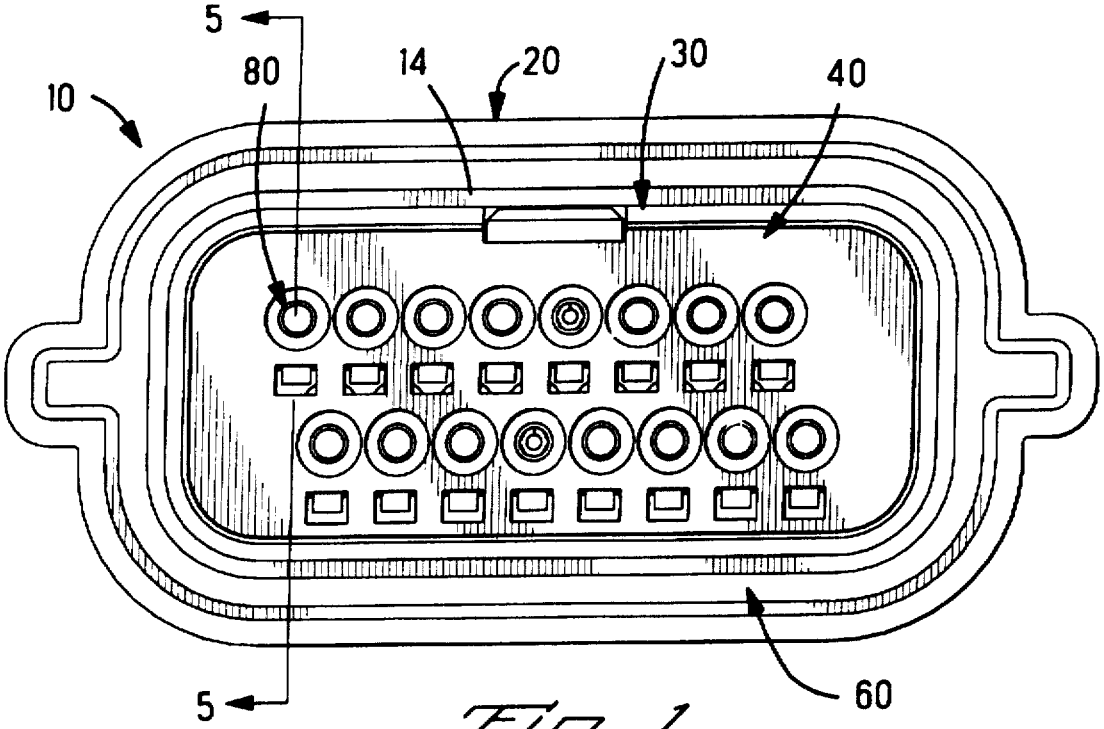
FIG. 1 shows a front elevational view of the plug housing assembly according to the present invention.
Figure 2:
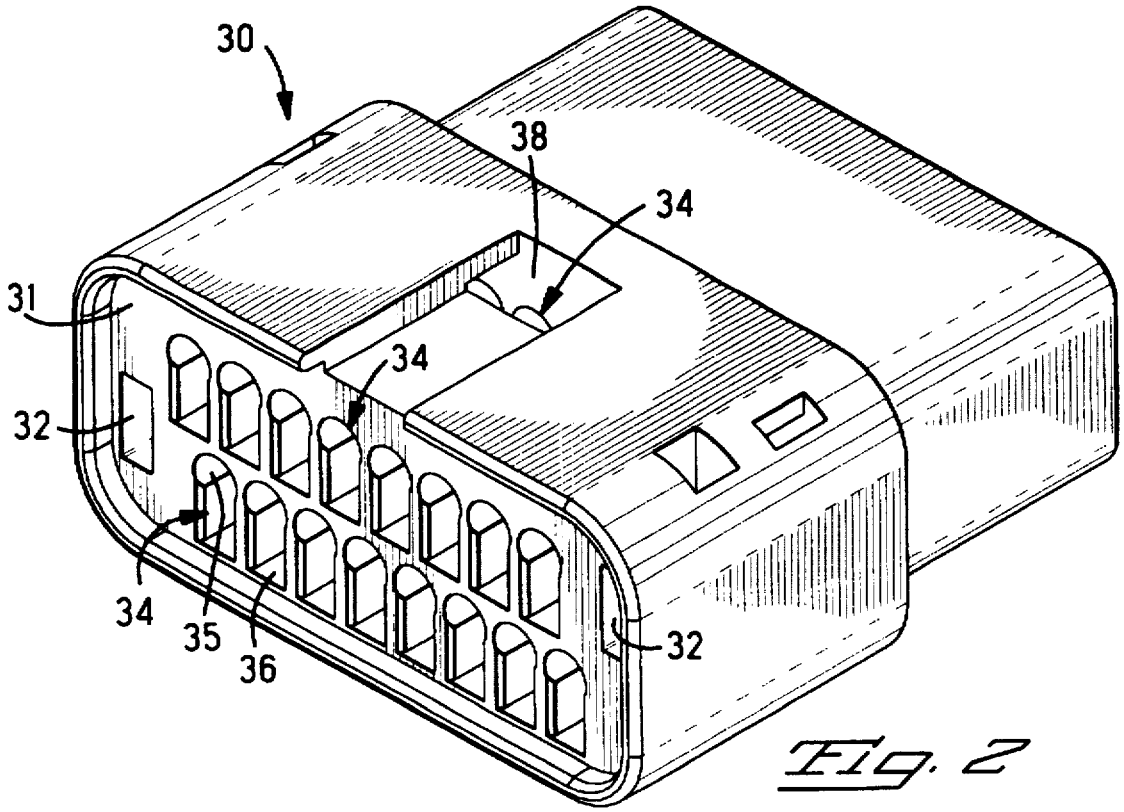
FIG. 2 shows an isometric drawing of the inner socket of FIG. 1.

FIG. 1 shows a plug housing assembly 10 including the interface seal 14, an outer socket 20, an inner socket 30, a primary latching member 40, a secondary lock member 60, and an electrical contact assembly 80. FIG. 2 shows the inner socket 30 which includes a recess 31, latch receiving holes 32, contact receiving apertures 34 with a contact chamber 35 and a latch chamber 36, and an inspection recess 38 in a top surface thereof.

Figure 3:
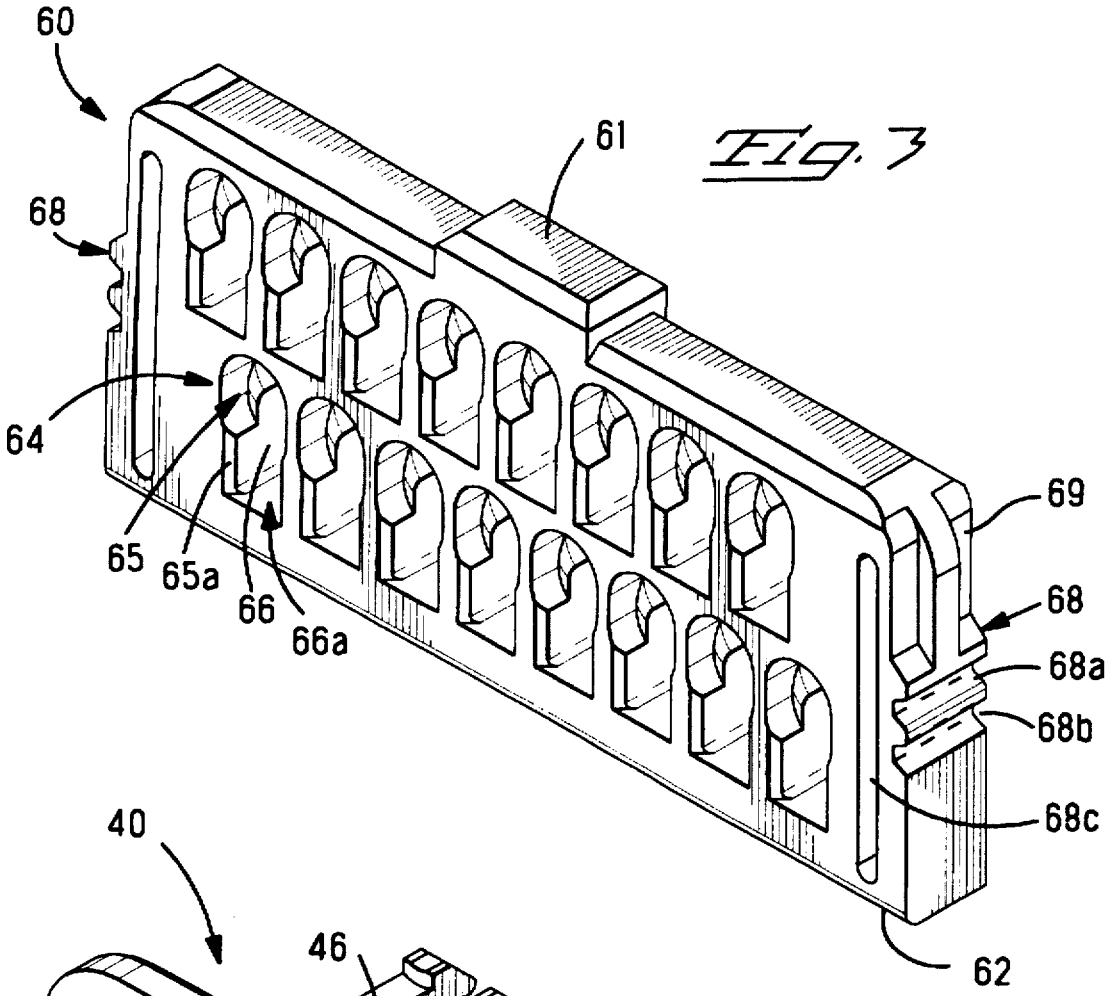
FIG. 3 shows an isometric view of the secondary lock member of FIG. 1.
Figure 4:
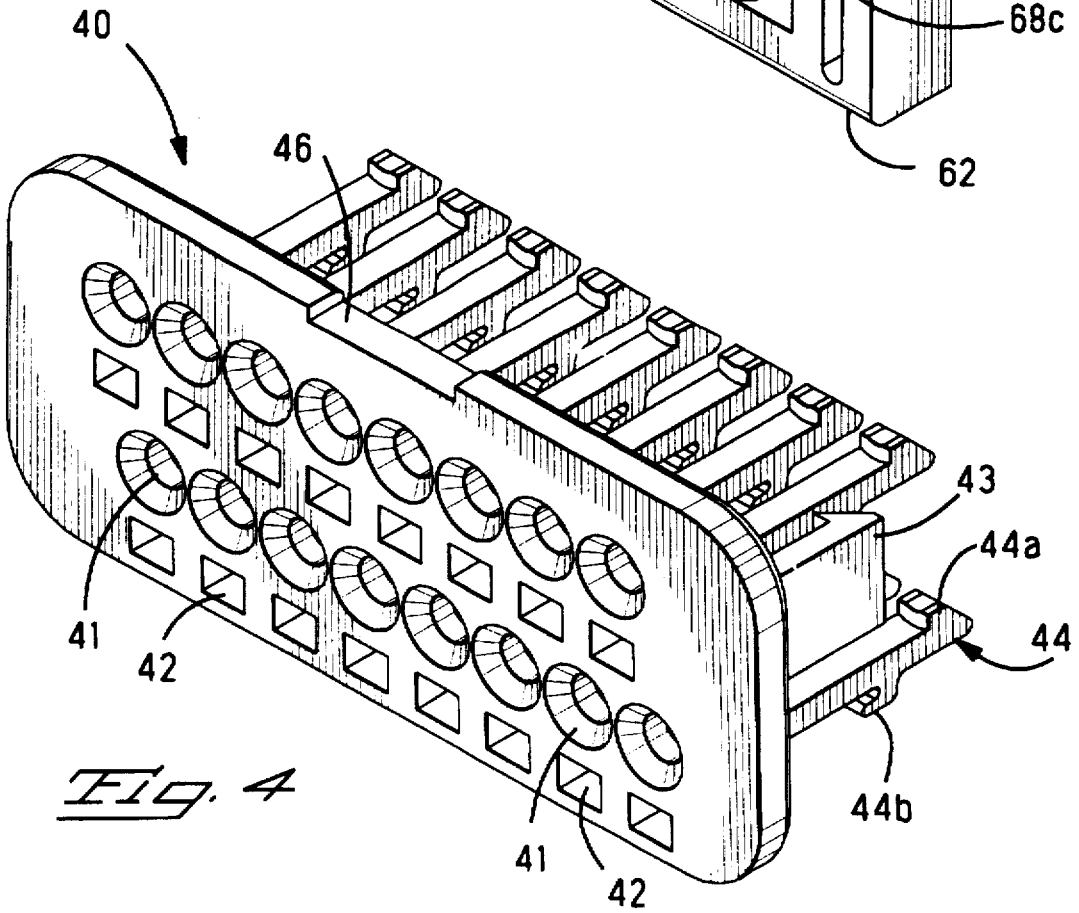
FIG. 4 shows an isometric view of the primary latching member of FIG. 1.

FIG. 3 shows the secondary lock member 60 with an embossment 60, a lower edge 62, a plurality of contact receiving apertures 64 each including a respective contact chamber 65 having a wall **65*a* and latch chamber 66 with a bottom wall 66*a*. Secondary lock member 60 further includes securing members 68 each having a first recess 68*a*, a second recess 68*b*, and a void space 68*c* which are formed on a deflectable beam 69. FIG. 4 shows primary latching member 40 with a plurality of pin receiving apertures 41, tool receiving apertures 42, latching lugs 43, latching beams 44 each having a respective contact engaging shoulder 44*a* and a tool engaging prong 44*b*, and a notch 46**.

Figure 5:
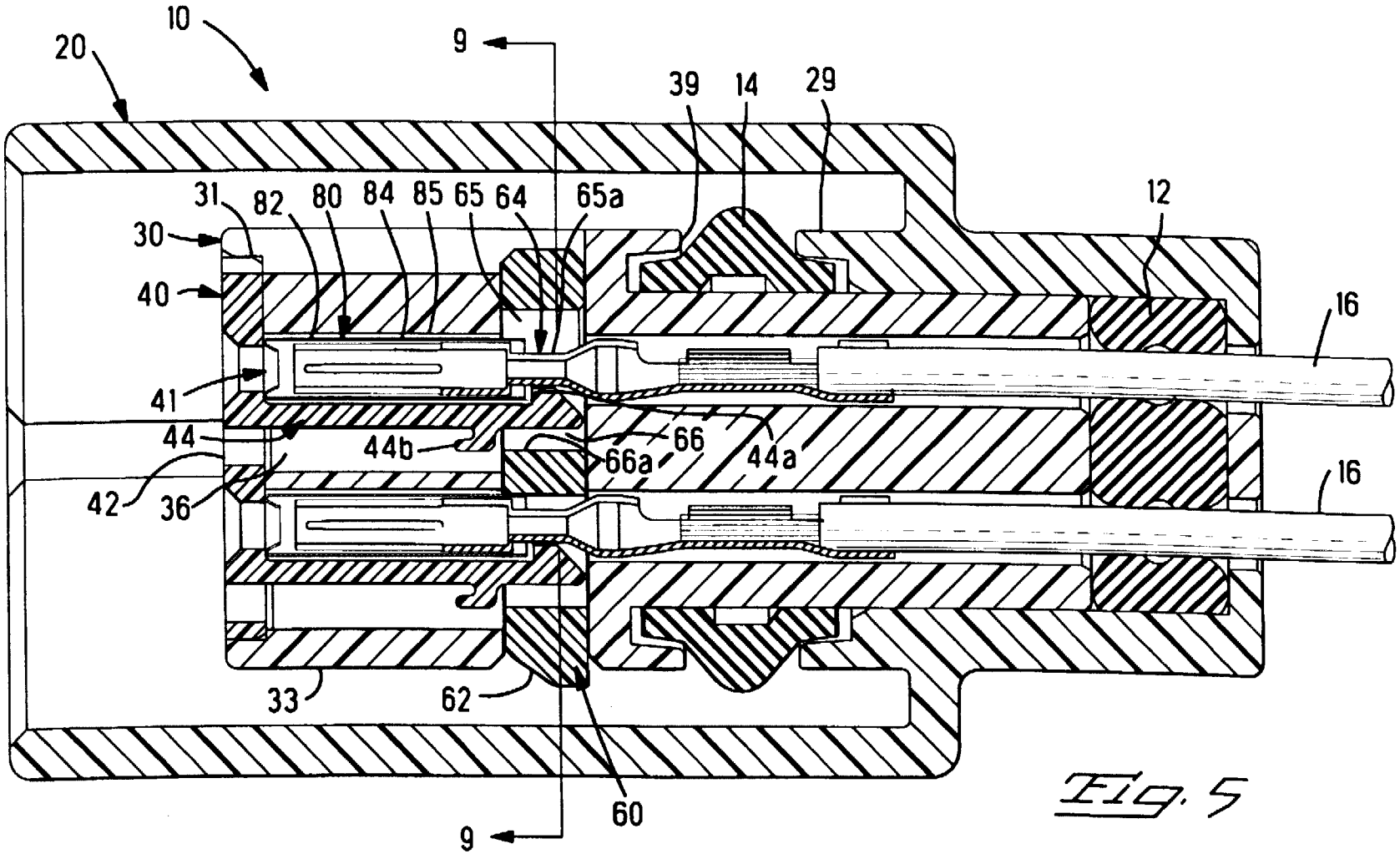
FIG. 5 shows a cross sectional view of the plug housing assembly of FIG. 1 taken along line 5—5 of FIG. 1.

FIG. 5 shows an assembly view of the previously described components of the plug housing assembly 10 when in a contact insertion state. Additionally, wire seal 12, interface seal 14, conductive wire 16, and sealing ledges 29 and 39 are shown as well. An electrical contact 80 is shown which includes a sleeve 82 and a contact section 84. The electrical contact 80 is inserted through wire receiving aperture 22 of outer socket 20, through wire seal 12, into contact chamber 35 of inner socket 30, and then through contact receiving aperture 64 of secondary lock member 60.

Finally, the electrical contact sleeve 82 engages a back surface of primary latching member 40 adjacent to pin receiving apertures 41 thereof. As shown in FIG. 5, the latching beam 44 is aligned with the electrical contact 80 and contact engaging shoulder 44*a* is aligned for engagement with sleeve 82. At this point, because secondary lock member 60 is in the contact insertion state, it is not in a fully inserted position within recess 37 of inner socket 30.

Additionally, it is important to note that there is a gap between latching beam 44 and bottom wall 66*a* of latch chamber 66 thereby allowing the latching beam 44 to resile downwardly when electrical contact 80 is being inserted into its final position. Moreover, a tool can be inserted through tool receiving aperture 42 to engage tool engaging prong 44*b* of latching beam 44 to thereby deflect the beam downwardly so that the electrical contact assembly 80 can be removed from the plug housing assembly 10.

Furthermore, it is sleeve 82 of electrical contact 80 which will frictionally engage the contact engaging shoulder 44*a* of latching beam 44 thereby providing a high degree of retention forces for resisting any axially directed separating forces acting on wire 16. Moreover, it is important to note that lower edge 62 of secondary lock member 60 is disposed below a lower surface 33 of inner socket 30 whereby a matable connector (not shown in the drawing) which is adapted to mate to plug housing assembly 10 will abut against lower shoulder 62 at this point thereby preventing full mating of the other matable connector with the plug housing assembly 10. This is advantageous because it prevents the full mating of the respective housing members prior to the secondary locking of the electrical contacts.

Figure 6:
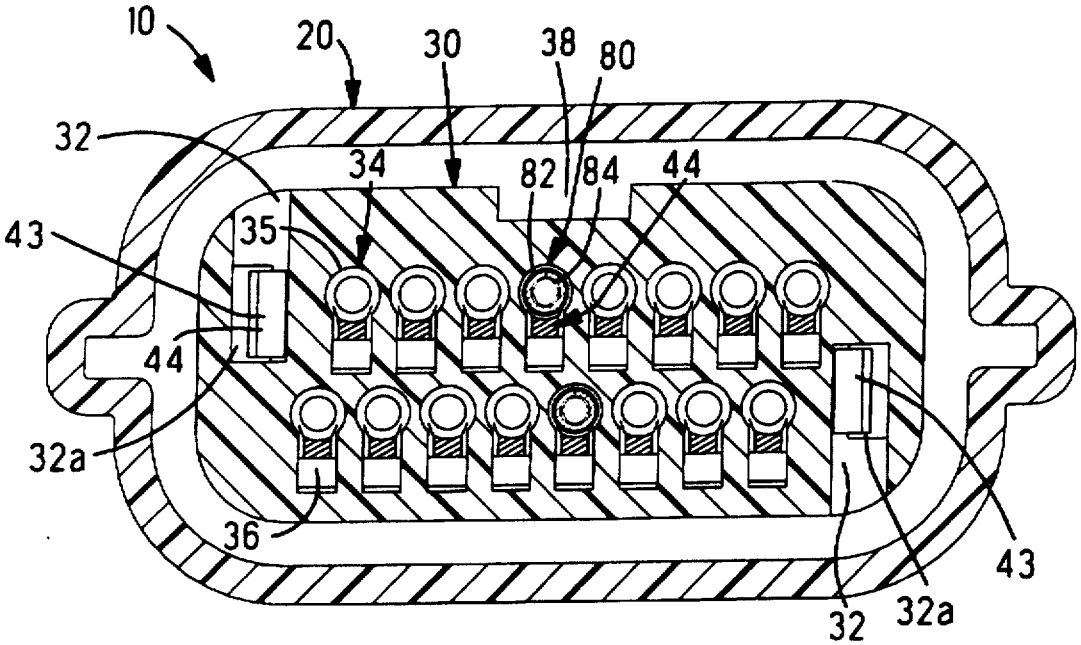
FIG. 6 shows a cross sectional view of the plug housing of FIG. 1 taken along line 6—6 of FIG. 5.

FIG. 6 shows the latching lugs 43 of primary latching member 40 engaging shoulders 32*a* of latch receiving holes 32 of inner socket 30. Note that latching beams 44 are disposed adjacent to electrical contact assemblies 80 as provided for when the secondary locking member is in the contact insertion position.

Figure 7:
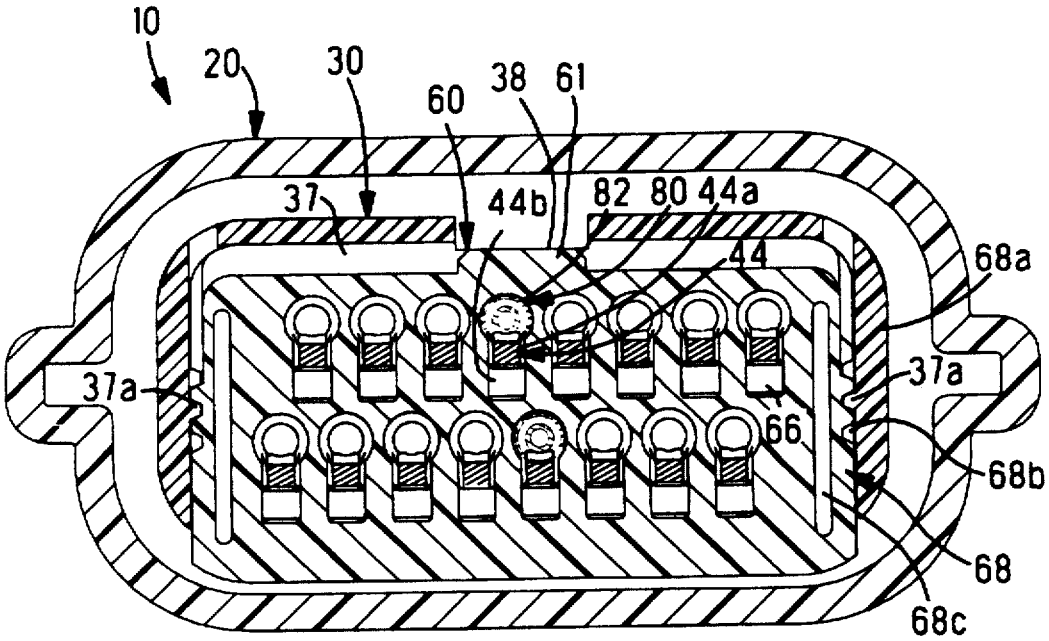
FIG. 7 shows a cross sectional view of the plug housing assembly of FIG. 1 taken along line 7—7 of FIG. 5.

FIG. 7 shows a cross sectional view through the secondary lock member 60 looking towards primary latching member 40. Inner socket 30 is shown including secondary lock member recess 37 with retaining bumps 37*a* formed on the sides thereof for engaging first recess 68*a* of securing member 68. At this point, the secondary lock member is not in its fully inserted position; however, as it is moved into its fully inserted position, embossment 61 of secondary lock member 60 will be pushed into inspection recess 38 of inner socket 30. Additionally, beams 69 will be deflected inwardly closing up void 68*c* of securing member 68 as bumps 37*a* deflect beam 69 inwardly, and the bumps 37*a* will be moved from first recess 68*a* to second recess 68*b* as the secondary lock member 60 is moved into its fully inserted position. As shown in FIG. 7, latching beam 44 positions contact engaging shoulders 44*a* into engagement with sleeves 82 of electrical contact 80, thereby latching the electrical contacts 80 into a primary latched position.

Figure 8:
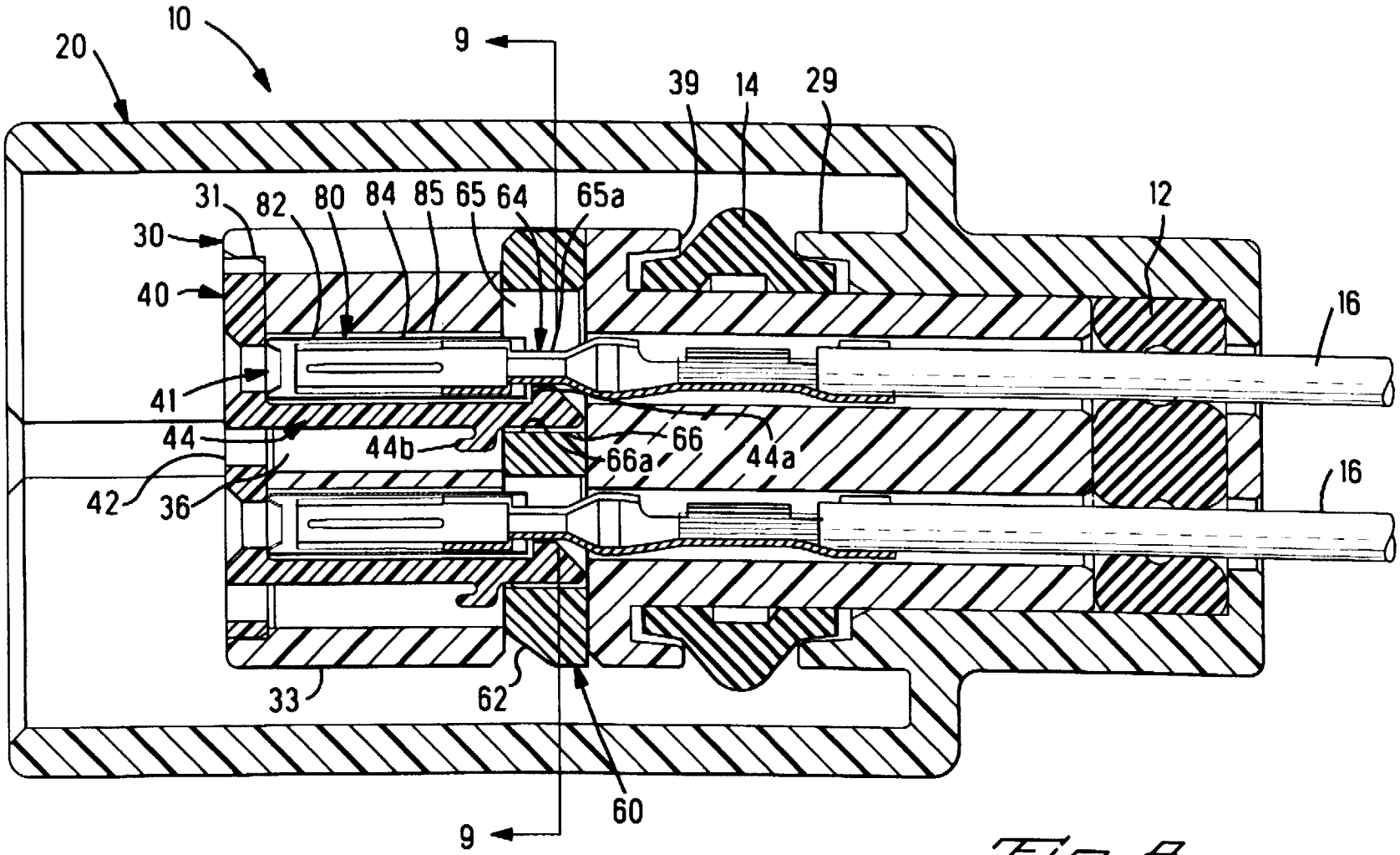
FIG. 8 shows a cross sectional view of the plug housing assembly of FIG. 1 similar to that of FIG. 5, but with the secondary lock member fully advanced into the inner socket.

FIG. 8 shows the plug housing assembly 10 with the secondary lock member 60 in a fully inserted position into inner socket 30. At this point, bottom wall 66*a* of latch chamber 66 is aligned to abut latching beam 44 so that latching beam 44 will be maintained in a positively locked position. Referring back to FIG. 3, it is important to note that walls 65*a* of contact chamber 65 will engage the respective sleeves 82 of electrical contacts 80 of contacts which are not fully inserted, thereby axially pushing the electrical contacts toward primary latching member 40 so that the secondary lock member 60 can be fully inserted. As noted above, retaining bumps 37*a* will be moved into recesses 68*b* of securing member 68 when the secondary lock member has been fully inserted thereby assuring that bottom walls 66*a* will be arranged for engagement with respective latching beams 44. Additionally, lower edge 62 of secondary lock member 60 is shown as substantially flush with lower surface 33 of inner socket 30, thereby permitting a matable housing to be fully mated with the plug housing assembly 10 so that the mating housing will be engageable with interface seal 14 in the area of ledges 29 and 39.

Figure 9:
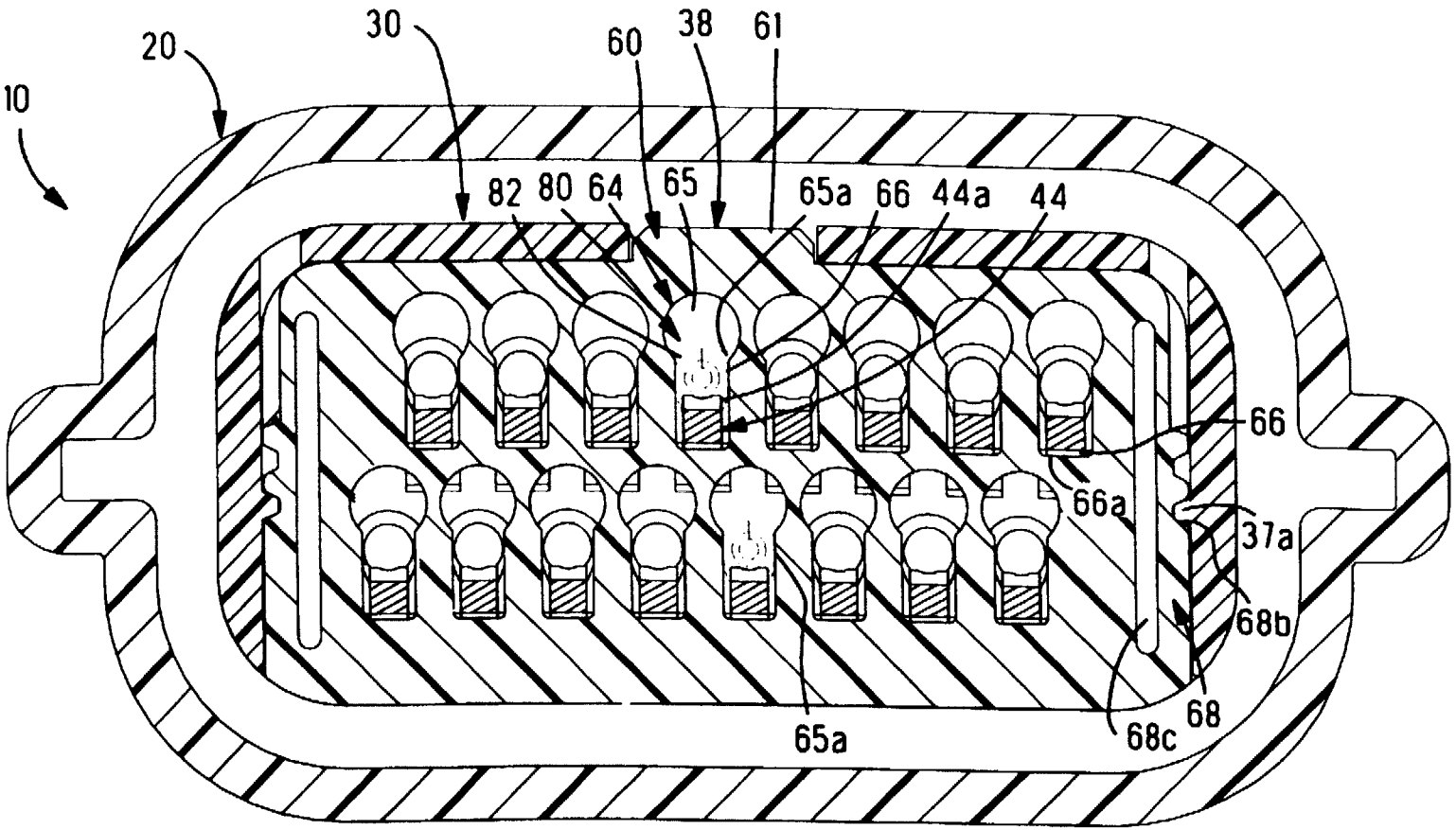
FIG. 9 shows a cross sectional view of the plug housing assembly of FIG. 1 taken along line 9—9 of FIG. 8.

FIG. 9 shows a cross sectional view of the secondary lock member 60 when it is in the fully inserted position. It is important to note that walls 65*a* of contact chamber 65 of secondary lock member 60 are aligned for abutting engagement with sleeves 82 of electrical contacts 80 thereby locking the electrical contacts 80 in a secondarily locked position. Additionally, any separating force applied to wire 16 will cause the shoulders 44*a* of latching beams 44 to be resiliently deflected downwardly but will be stopped from further deflection by engaging bottom walls 66*a* of latch chamber 66. Thus the electrical contacts 80 are locked into position by each contact respectively arranged for abutting engagement with both shoulder 44*a* and walls 65*a*. Moreover, when the secondary lock member 60 is in the fully inserted position it will be obvious to the operator by viewing embossment 61 at inspection recess 38 that the secondary lock member has been fully inserted.

It is contemplated that the plug housing assembly 10 described above can be formed of any suitable engineering plastic or other dielectric material. Thus, while a preferred embodiment of the invention has been disclosed, it is to be understood that the invention is not to be strictly limited to such embodiment but may be otherwise variously embodied and practiced within the scope of the appended claims.

Accordingly, what is claimed is:

1. An electrical plug housing assembly for receiving at least one electrical contact therein and for matable connection with a further electrical housing, said plug housing assembly comprising:

(a) a housing having at least one contact receiving aperture, a primary latching member, and a housing recess for receiving a secondary locking member;

(b) said primary latching member includes at least one deflectable latching beam formed thereon, said primary latching member having a free end;

(c) a secondary locking member disposed in said housing recess, said secondary locking member comprises at least one contact receiving aperture;

(d) said free end is generally located in the contact receiving aperture of the secondary locking member; and (e) upon engagement of the free end with an electrical contact inserted through said contact receiving aperture of the secondary locking member, said free end is operative to deflect and move into a locking position relative to said electrical contact within said contact receiving aperture of the secondary locking member.

2. The electrical plug housing assembly of claim 1, wherein said deflectable beam comprises a prong for receiving a tool whereby manipulation of the prong deflects the beam.

3. The electrical plug housing assembly of claim 1, wherein said primary latching member comprises a separate part mated to said socket housing.

4. An electrical plug housing assembly for receiving at least one electrical contact therein and for matable connection with a further electrical housing, said plug housing assembly comprising:

(a) a socket housing having at least one contact receiving aperture, a primary latching member, and a housing recess for receiving a secondary locking member;

(b) said primary latching member includes at least one deflectable latching beam formed thereon for providing primary locking of an electrical contact;

(c) a secondary locking member disposed in said housing recess, said secondary locking member comprises at least one contact receiving aperture, and said secondary locking member is movable in said housing recess between secondary locking and pre-locking positions; and d) said secondary locking member comprises a secondary locking section, when the secondary locking member is in the secondary locking position in said housing recess said secondary locking section is operative to inhibit deflection of the deflectable latching beam by delimiting movement thereof, thereby providing secondary locking of said electrical contact.

5. The electrical plug housing assembly of claim 4, wherein said primary latching member comprises a separate part mated to said socket housing.

6. An electrical plug housing assembly for receiving at least one electrical contact therein and for matable connection with a further electrical housing, said plug housing assembly comprising:

(a) a socket housing having at least one contact receiving aperture, a primary latching member, and a housing recess for receiving a secondary locking member;

(b) said primary latching member includes at least one deflectable latching beam formed thereon for providing primary locking of an electrical contact;

(c) a secondary locking member disposed in said housing recess, said secondary locking member comprises at least one contact receiving aperture, and said secondary locking member is movable in said housing recess between secondary locking and pre-locking positions, the direction of movement of said secondary locking member being substantially transverse to an insertion direction of said electrical contact; and (d) said secondary locking member comprises wall structure comprising a periphery of said at least one aperture thereof, said wall structure is positioned for sliding engagement with a portion of said electrical contact, as said secondary locking member is moved in said housing recess, said wall structure is operative to slidably engage a portion of said electrical contact in said housing recess and thereby move said contact where said contact is in a less than fully inserted position.

7. The plug housing assembly of claim 6, wherein said wall structure comprises a tapered surface.

8. The plug housing assembly of claim 6 wherein said wall structure comprises a plurality of said peripheral sections being located laterally of said contact for secondarily locking said contact.

9. The electrical plug housing assembly of claim 6, wherein said primary latching member comprises a separate part mated to said socket housing.

* * * * *